US007007638B2

(12) United States Patent
Yamada

(10) Patent No.: US 7,007,638 B2
(45) Date of Patent: Mar. 7, 2006

(54) VARIABLE COMPRESSION RATIO ENGINE

(75) Inventor: Yoshikazu Yamada, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 24 days.

(21) Appl. No.: 10/898,539

(22) Filed: Jul. 26, 2004

(65) Prior Publication Data

US 2005/0061270 A1 Mar. 24, 2005

(30) Foreign Application Priority Data

Aug. 5, 2003 (JP) ..... 2003-286434

(51) Int. Cl.
*F02B 75/04* (2006.01)

(52) U.S. Cl. ..... 123/48 B; 123/78 E

(58) Field of Classification Search ..... 123/48 B, 123/78 E

See application file for complete search history.

(56) References Cited

U.S. PATENT DOCUMENTS 4,173,202 A 11/1979 Crise ..... 123/48

FOREIGN PATENT DOCUMENTS

| | | |
|---|---|---|
| EP | 1 201 894 A2 | 5/2002 |
| EP | 1 223 319 A1 | 7/2002 |
| EP | 1 347 161 A2 | 9/2003 |
| JP | 09-228858 | 9/1997 |
| JP | 9-228858 | 9/1997 |
| JP | 2000-73804 | 3/2000 |
| JP | 2000-073804 | 3/2000 |

*Primary Examiner*—Noah P. Kamen
(74) *Attorney, Agent, or Firm*—Arent Fox PLLC

(57) ABSTRACT

A variable compression ratio engine includes a connecting rod connected to a piston, a subsidiary arm connected to a crankshaft with one end pivotally connected to an end of the connecting rod, an eccentric shaft provided at an eccentric position of a rotary shaft rotatably supported at an engine body, and a control rod with one end connected to the subsidiary arm at a position deviated from the connected portion of the connecting rod and the other end pivotally connected to the eccentric shaft. In the variable compression ratio engine, a one-way clutch is interposed between the rotary shaft and the engine body, a restricted member is interlocked with and connected to an eccentric position of the rotary shaft to reciprocally operate corresponding to rotation of the rotary shaft, and a restricting device abuts to and engages with the restricted member immediately after the restricted member passes a reciprocation end, thereby selectively restricting a rotational operation of the rotary shaft in either of two rotation phases different from each other. Thus, the rotary shaft is rotated by utilizing the combustion and inertia of the engine, and occurrence of impact at the time of restricting the rotational operation of the rotary shaft can be suppressed.

2 Claims, 10 Drawing Sheets

VARIABLE COMPRESSION RATIO ENGINE

BACKGROUND OF THE INVENTION

1. Field of the Invention

The present invention relates to a variable compression ratio engine including a connecting rod with one end connected to a piston via a piston pin, a subsidiary arm with one end rotatably connected to the other end of the connecting rod and connected at a crankshaft via a crank pin, an eccentric shaft provided at an eccentric position of a rotary shaft rotatably supported at an engine body, and a control rod with one end connected to the subsidiary arm at a position deviated from the connecting position of the connecting rod and the other end rotatably connected to the eccentric shaft.

2. Description of the Related Art

Conventionally, such an engine is already known from, for example, Japanese Patent Application Laid-Open Nos. 9-228858 and 2000-73804, wherein the compression ratio is changed by restricting and holding the rotation position of the rotary shaft including the eccentric shaft in a plurality of rotation phases.

In the above-described conventional engines, an actuator such as an electric motor or a cylinder is connected to the rotary shaft. Since a tensile load and a compression load act on the control rod due to combustion and inertia of the engine, an impact load acts on the actuator, and therefore a means for relieving such impact is required to be provided between the actuator and the rotary shaft, thus complicating the construction.

If the rotational direction of the rotary shaft is restricted to one direction, the rotary shaft can be rotated in the one direction by utilizing the tensile load and compression load acting on the control rod by the combustion and inertia of the engine. With this construction, the actuator for driving the rotary shaft is not required. In this case, however, a restricting means for restricting and holding the rotary shaft in a plurality of rotation phases is necessary, and when such a restricting means is provided, it is desirable to prevent an impact load from acting on the contact portion between the restricting means and the rotary shaft.

SUMMARY OF THE INVENTION

The present invention has been achieved in view of the above circumstances, and has an object to provide a variable compression engine which rotates a rotary shaft by utilizing combustion and inertia of the engine, and is capable of suppressing occurrence of impact at a time of restricting a rotational operation of the rotary shaft.

In order to achieve the above object, according to a first feature of the present invention, there is provided a variable compression ratio engine including: a connecting rod with one end connected to a piston via a piston pin; a subsidiary arm connected to a crankshaft via a crank pin with one end rotatably connected to the other end of the connecting rod; an eccentric shaft provided at an eccentric position of a rotary shaft rotatably supported at an engine body; and a control rod with one end connected to the subsidiary arm at a position deviated from the connecting position with the connecting rod and the other end pivotally connected to the eccentric shaft, wherein the engine further includes: a one-way clutch interposed between the rotary shaft and the engine body so as to restrict a rotating direction of the rotary shaft to one direction, the rotating direction of the rotary shaft corresponding to a rotational force which acts on the rotary shaft via the eccentric shaft from the control rod following a reciprocating operation of the piston; a restricted member linked and connected to the eccentric position of the rotary shaft to reciprocally operate in response to rotation of the rotary shaft; and a restricting means for switching a compression ratio to a high level and a low level by selectively restricting a rotational operation of the rotary shaft in either of two rotation phases different from each other in such a manner that the restricting means abuts to and engages with the restricted member immediately after the restricted member passes a reciprocation end.

With the first feature, the rotary shaft is rotated in one direction restricted by the one-way clutch because of the tensile load and compression load acting on the control rod by the combustion and inertia of the engine, and the rotational operation of the rotary shaft can be restricted and held in the two rotation phases differing from each other by the restricting means abutting to and engaging with the restricted member, thereby changing the compression ratio to a high level and a low level. In addition, the restricting means abuts to and engages with the restricted member immediately after the restricted member, which is reciprocally operated corresponding to the rotation of the rotary shaft, passes the reciprocation end. Therefore, the restricting means abuts to and engages with the restricted member in a state in which the operating speed of the restricted member is low, thus reducing the impact at the time of changing the compression ratio, and suppressing the occurrence of impact noise.

In addition to the construction of the first feature, according to a second feature of the present invention, the restricted member has a locking portion and is supported at the engine body or a support means mounted to the engine body to be rotatable around an axis line parallel to the rotary shaft; a reciprocating rod has one end connected to the eccentric position of the rotary shaft to be rotatable around an axis line coaxial with the eccentric shaft, and has the other end connected to the restricted member so that the restricted member is pivotally reciprocated between first and second reciprocation ends corresponding to the rotation of the rotary shaft; the restricting means includes a first restricting member having a first engaging portion capable of abutting to and engaging with the locking portion from one side in a circumferential direction immediately after the restricted member passes the first reciprocation end, and a second restricting member having a second engaging portion capable of abutting to and engaging with the locking portion of the restricted member from the other side in the circumferential direction immediately after the piston passes the second reciprocation end, the first and second engaging portions being pivotally supported at the engine body or the support means while interlocking with and connecting to each other so that when one of the first and second engaging portions abuts to and engages with the locking portion, the other one of the first and second engaging portions is retreated to a position where it avoid abutment to and engagement with the locking portion; and an actuator supported at the engine body to be operated in accordance with an engine load is interlocked with and connected to the first and second restricting members to pivotally drive the first and second restricting members.

With the second feature, one of the first and second engaging portions can be made to abut to and engage with the locking portion of the restricted member, immediately after the restricted member passes the reciprocation end by pivotally driving the first and second restricting members of the restricting means with the operation of the actuator operated in accordance with the engine load, and the compression ratio can be switched to a high level and a low level in accordance with the engine load while the impact at the time of switching the compression ratio is suppressed to be low with the simple structure.

The above described object and the other objects, the characteristics and the advantages in the present invention will become apparent from the preferred embodiment which will be described in detail below with reference to the attached drawings.

DESCRIPTION OF THE PREFERRED EMBODIMENT

Figure 1:
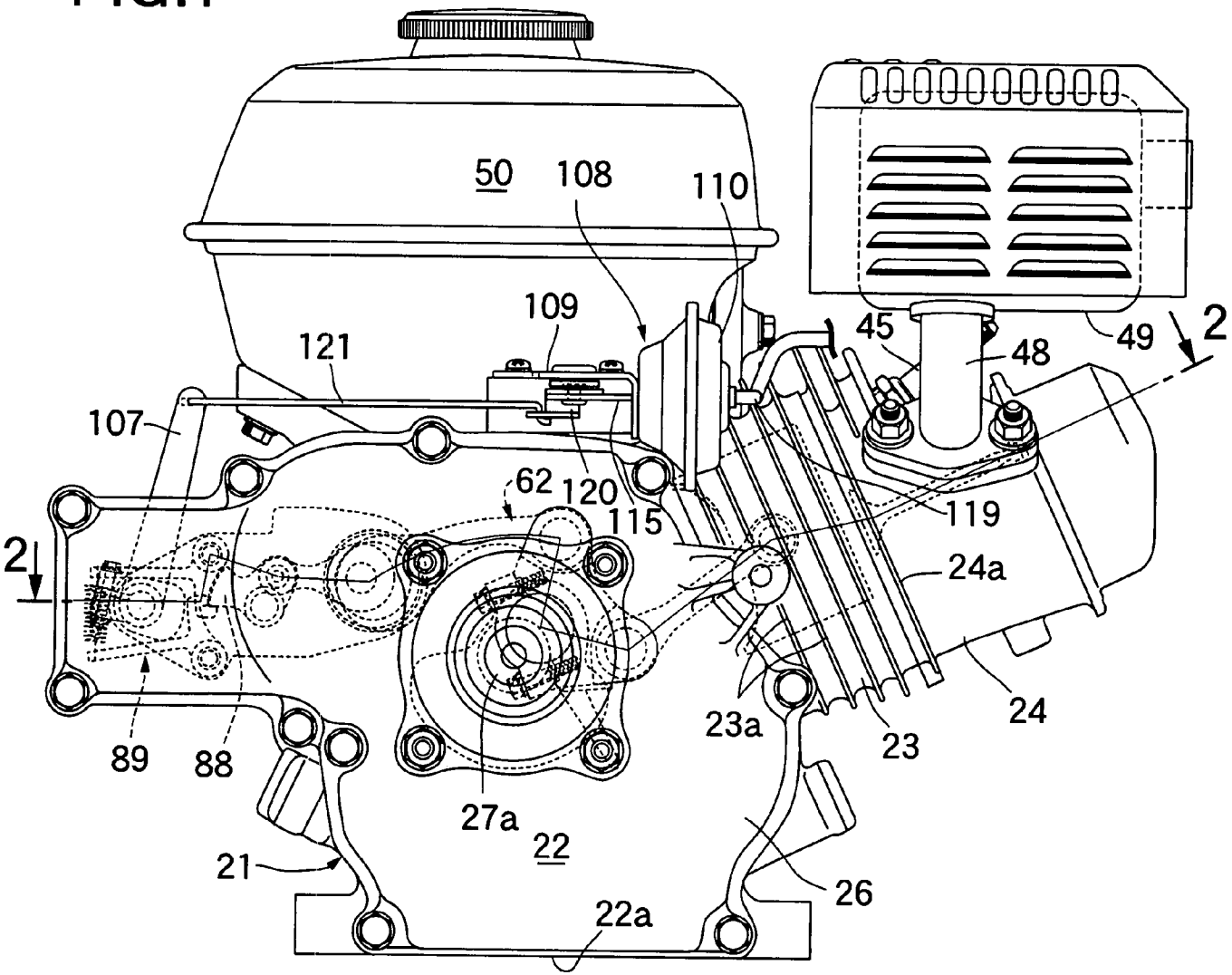
FIG. 1 is a front view of an engine according to an embodiment of the present invention.
Figure 2:
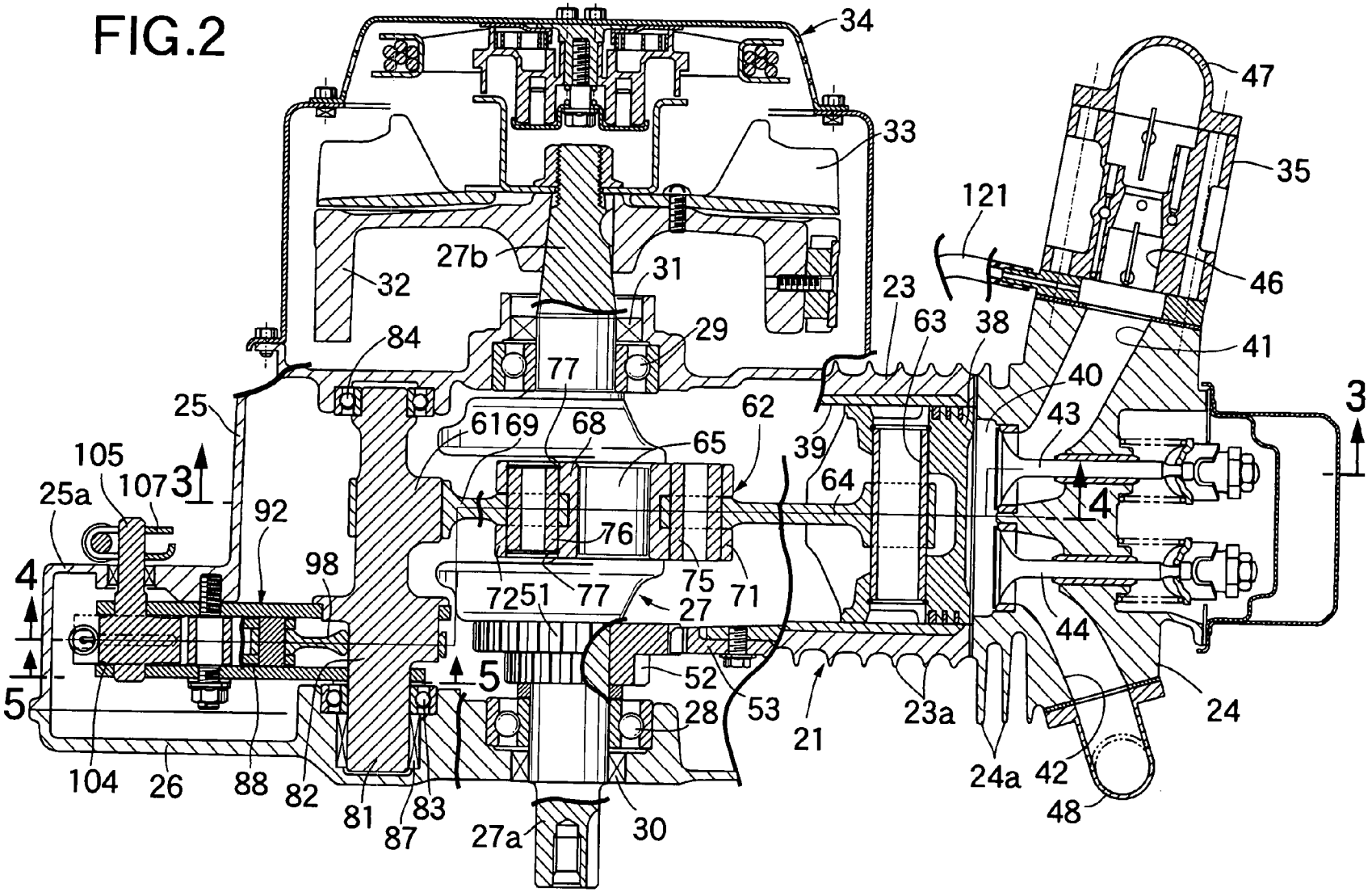
FIG. 2 is a sectional view taken along the line 2—2 in FIG. 1.
Figure 3:
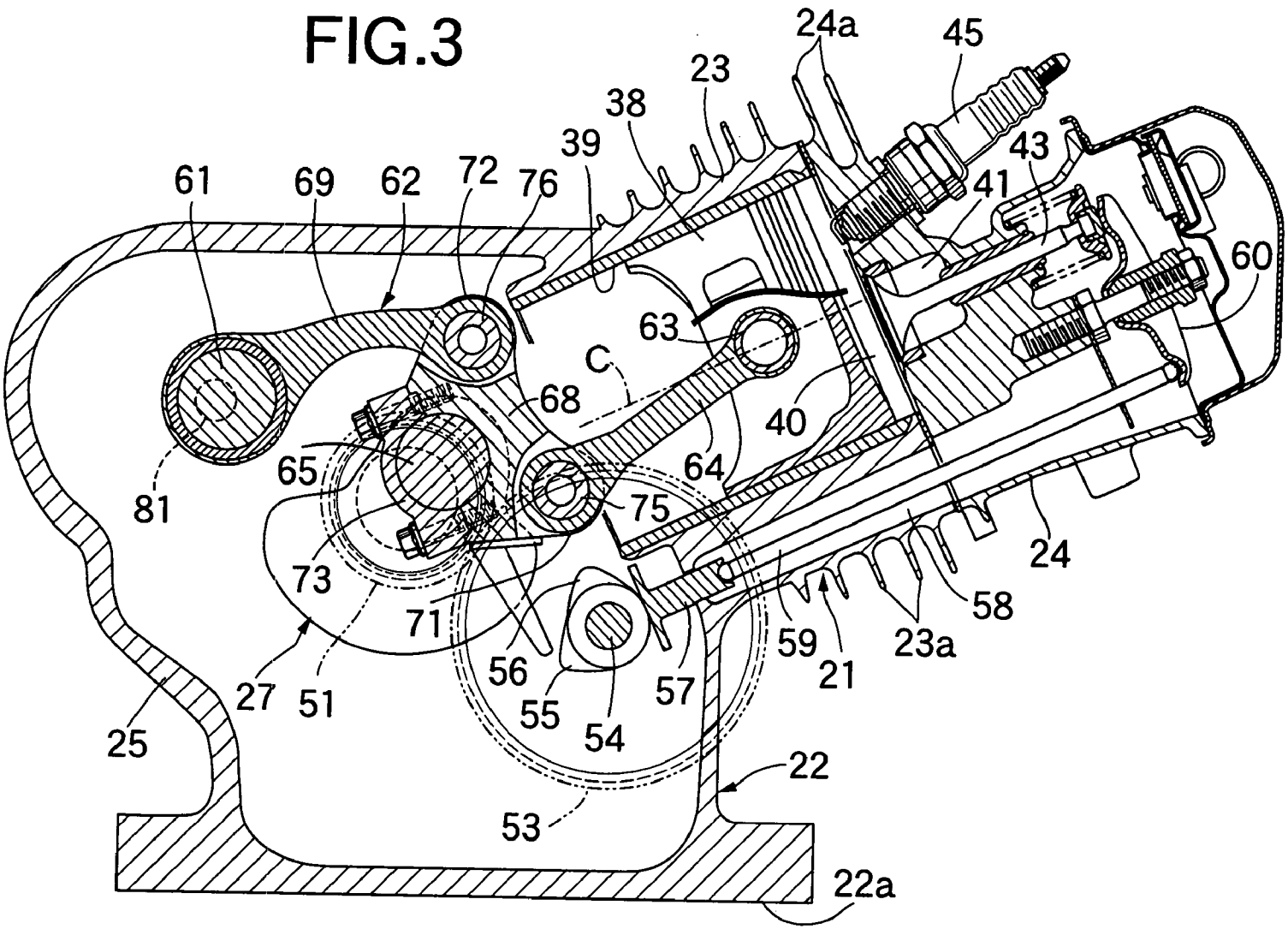
FIG. 3 is a sectional view taken along the line 3—3 in FIG. 2.

One embodiment of the present invention will be described below with reference to FIG. 1 to FIG. 10. An engine in FIGS. 1 to 3 is an air cooled single cylinder engine used for a working machine or the like, and an engine body 21 is constructed by a crankcase 22, a cylinder block 23 protruding to be inclined slightly upward from one side surface of the crankcase 22, and a cylinder head 24 joined to a head portion of the cylinder block 23. A large number of air cooling fins 23*a* . . . , and 24*a* . . . are provided on outer periphery surfaces of the cylinder block 23 and the cylinder head 24. The crankcase 22 is mounted on each of engine beds of various working machines on a mounting surface 22*a* of an undersurface of the crankcase 22.

The crankcase 22 is constituted of a case body 25 formed integrally with the cylinder block 23 by casting, and a side cover 26 connected to an open end of the case body 25. One end 27*a* of a crankshaft 27 is protruded from the side cover 26, and a ball bearing 28 and an oil seal 30 are interposed between the one end 27*a* of the crankshaft 27 and the side cover 26. The other end 27*b* of the crank shaft 27 is protruded from the case body 25, and a ball bearing 29 and an oil seal 31 are interposed between the other end 27*b* of the crankshaft 27 and the case body 25.

A flywheel 32 is fixed to the other end 27*b* of the crankshaft 27 outside the case body 25. A cooling fan 33 for supplying cooling air to each part of the engine body 21 is fixed to the flywheel 32, and a recoil starter 34 is placed outside the cooling fan 33.

A cylinder bore 39 into which a piston 38 is slidably fitted is formed in the cylinder block 23, and a combustion chamber 40 which a top portion of the piston 38 faces is formed between the cylinder block 23 and the cylinder head 24.

In the cylinder head 24, an inlet port 41 and an exhaust port 42 communicable with the combustion chamber 40 are formed; and an intake valve 43 for opening and closing communication between the intake port 41 and the combustion chamber 40, and an exhaust valve 44 for opening and closing communication between the exhaust port 42, and the combustion chamber 40 are placed to be operable of opening and closing. An ignition plug 45 is screwed into the cylinder head 24 so that its electrodes face the combustion chamber 40.

A carburetor 35 is connected to an upper portion of the cylinder head 24, and a downstream end of an intake passage 46 of the carburetor 35 communicates with the intake port 41. An intake pipe 47 connecting to an upstream end of the intake passage 46 is connected to the carburetor 35, and the intake pipe 47 is connected to an air cleaner not shown. An exhaust pipe 48 communicating with the exhaust port 42 is connected to an upper portion of the cylinder head 24, and the exhaust pipe 48 is connected to an exhaust muffler 49. A fuel tank 50 is disposed above the crankcase 22 in such a manner that it is supported by the crankcase 22.

A first drive gear 51, and a second drive gear 52 integral with the first drive gear 51 and having a diameter of ½ of that of the first drive gear 51 are fixed to the crankshaft 27 in a portion near the side cover 26 in the crankcase 22. A first driven gear 53 meshed with the first drive gear 51 is fixed to a camshaft 54 having an axis parallel to that of the crankshaft 27 and rotatably supported at the crankcase 22. Thus, the rotating force is transmitted at a reduction ratio of ½ from the crankshaft 27, through the first drive gear 51 and the first driven gear 53 meshed with each other, to the camshaft 54.

The camshaft 54 is provided with an intake cam 55 and an exhaust cam 56 corresponding to the intake valve 43 and the exhaust valve 44 respectively, and a follower piece 57 operably supported at the cylinder block 23 is brought into sliding contact with the intake cam 55. On the other hand, an operating chamber 58, in which an upper portion of the follower piece 57 protruding downward, is formed in the cylinder block 23 and the cylinder head 24. A lower end of a push rod 59 disposed in the operating chamber 58 abuts to the follower piece 57. A rocker arm 60 is swingably supported at the cylinder head 24, with its one end abutting to an upper end of the intake valve 43 biased in a valve closing direction, and an upper end of the push rod 59 abuts to the other end of the rocker arm 60. Thus, the push rod 59 is operated in an axial direction in response to the rotation of the intake cam 55, and correspondingly the swing of the rocker arm 60 causes the intake valve 43 to perform opening and closing operation.

A mechanism similar to that interposed between the above described in take cam 55 and the intake valve 43 is interposed between the exhaust cam 56 and the exhaust valve 44, and thus the exhaust valve 44 performs opening and closing operation corresponding to the rotation of the exhaust cam 56.

Figure 4:
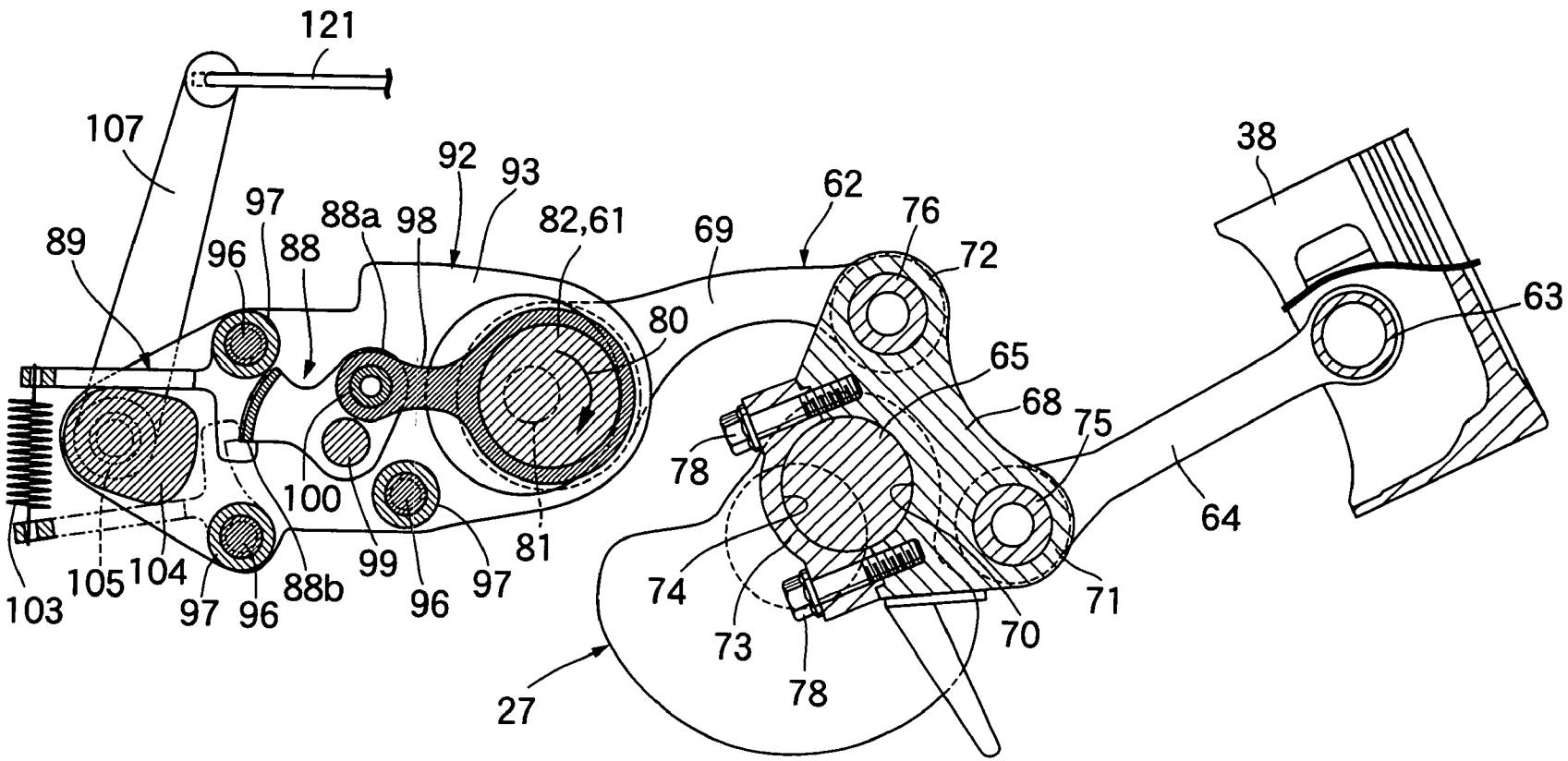
FIG. 4 is an enlarged sectional view taken along the line 4—4 in FIG. 2.

Referring also to FIG. 4, the piston 38, the crankshaft 27, and an eccentric shaft 61 having an axis parallel to the axis of the crankshaft 27 and supported at the crankcase 22 of the engine body 21 are connected one another via a link mechanism 62.

The link mechanism 62 is constituted of a connecting rod 64 with one end connected to the piston 38 via a piston pin 63, a subsidiary arm 68 connected to the crankshaft 27 via a crank pin 65 and pivotally connected to the other end of the connecting rod 64, and a control rod 69 with one end pivotally connected to the subsidiary arm 68 at a position displaced from a connecting position of the connecting rod 64. The other end of the control rod 69 is pivotally connected to the eccentric shaft 61.

The subsidiary arm 68 has, in its middle portion, a semicircular first bearing portion 70 in sliding contact with a half of a periphery of the crank pin 65. Integrally provided at opposite ends of the subsidiary arm 68 are a pair of forked portions 71 and 72 respectively holding the other end of the connecting rod 64 and the one end of the control rod 69. A semicircular second bearing portion 74 of a crank cap 73 is in sliding contact with the remaining half of the periphery of the crank pin 65, and the crank cap 73 is fastened to the subsidiary arm 68.

The other end of the connecting rod 64 is rotatably connected to one end of the subsidiary arm 68 via a cylindrical connecting rod pin 75. Opposite ends of the connecting rod pin 75 press-fitted into the other end of the connecting rod 64 are pivotally fitted onto the forked portion 71 at the one end side of the subsidiary arm 68.

One end of the control rod 69 is pivotally connected to the other end of the subsidiary arm 68 via a cylindrical subsidiary arm pin 76. Opposite ends of the subsidiary arm pin 76 relatively pivotally penetrating through the one end of the control rod 69 inserted into the forked portion 72 at the other end side of the subsidiary arm 68 are clearance-fitted into the forked portion 72 at the other end side. A pair of clips 77 and 77 for preventing the subsidiary arm pin 76 from disengaging from the forked d portion 72 by abutting to the opposite ends of the subsidiary arm pin 76 are attached to the forked portion 72 at the other end side.

The crank cap 73 is fastened to the forked portions 71 and 72 by bolts 78, 78 . . . each pair of which is disposed at opposite sides of the crankshaft 27. The connecting rod pin 75 and the subsidiary arm pin 76 are disposed on the extended axial lines of the bolts 78, 78 . . . .

The eccentric shaft 61 is integrally provided at an eccentric position of a rotary shaft 81 having an axis parallel to the crankshaft 27 and rotatably supported at the crankcase 22 of the engine body 21. The rotary shaft 81 is provided with an eccentric shaft 82 coaxial with the eccentric shaft 61 and spaced from the eccentric shaft 61 in the axial direction. One end of the rotary shaft 81 is rotatably supported at the side cover 26 in the crankcase 22 via a ball bearing 83, and the other end of the rotary shaft 81 is rotatably supported at the case body 25 in the crankcase 22 via a ball bearing 84.

A tensile load acts on the control rod 69 with the other end connected to the eccentric shaft 61 when the piston 38 slides from the top dead center to the bottom dead center, and a compression load acts on the control rod 69 when the piston 38 slides from the bottom dead center to the top dead center. Since the eccentric shaft 61 is provided at the eccentric position of the rotary shaft 81, a rotational force to one side and a rotational force to the other side from the control rod 69 alternately act on the rotary shaft 81 by alternate action of the tensile load and the compression load. Thus, a one-way clutch 87 is interposed between the rotary shaft 81 and the side cover 26 in the crankcase 22, and the rotary shaft 81 is rotatable in only one direction shown by the arrow 80 in FIG. 4.

A restricted member 88 is linked and connected to an eccentric position of the rotary shaft 81 to operate reciprocally in response to the rotation of the rotary shaft 81. A restricting means 89 is capable of abutting to and engaging with the restricted member 88. The restricting means 89 is capable of selectively restricting the rotational operation of the rotary shaft 81 in either one of two rotational phases differing from each other by abutting to and engaging with the restricted member 88 immediately after the restricted member 88 passes the reciprocation end, thereby switching the compression ratio of the engine to a high level and a low level.

Figure 5:
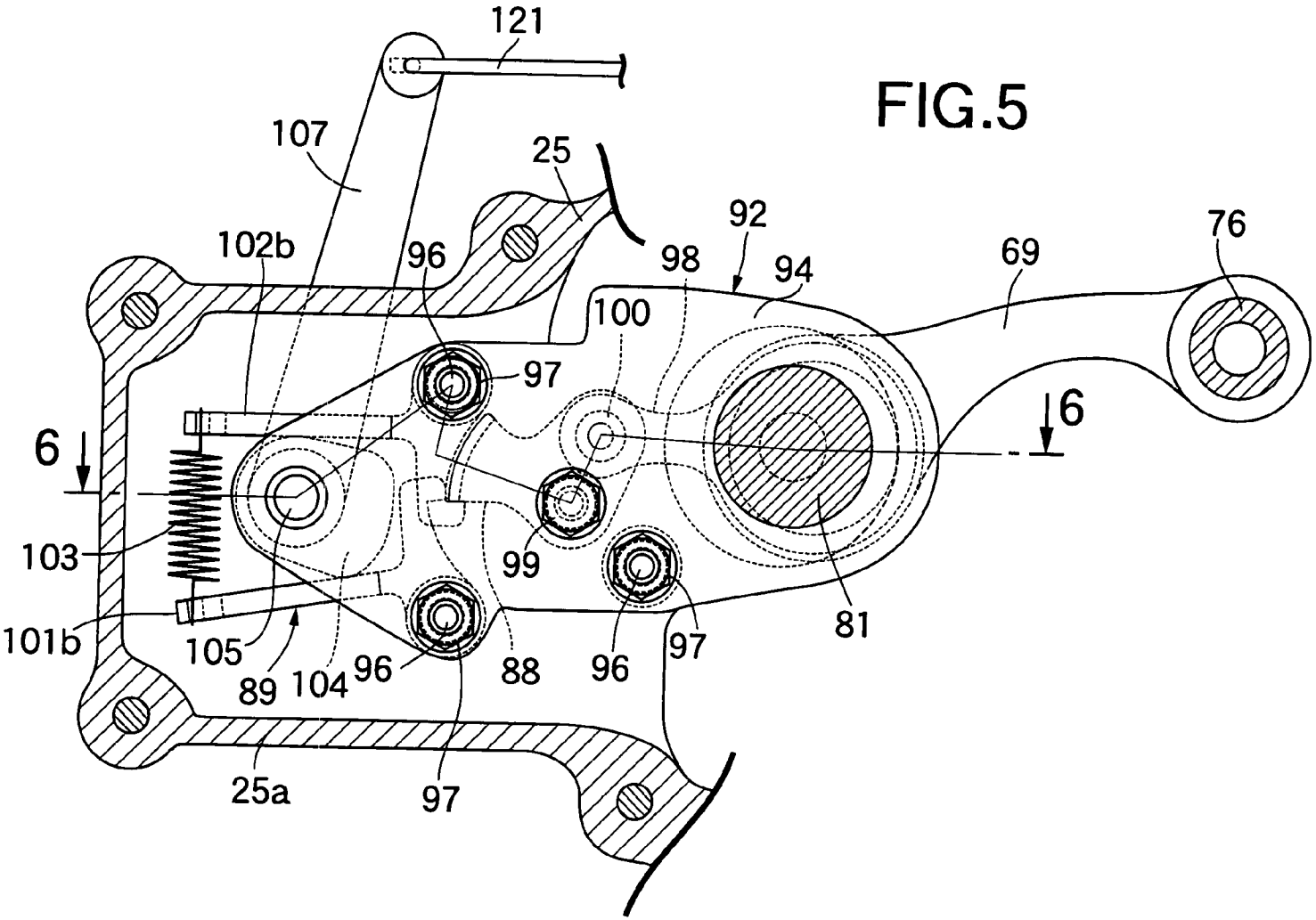
FIG. 5 is an enlarged sectional view taken along the line 5—5 in FIG. 2.
Figure 6:
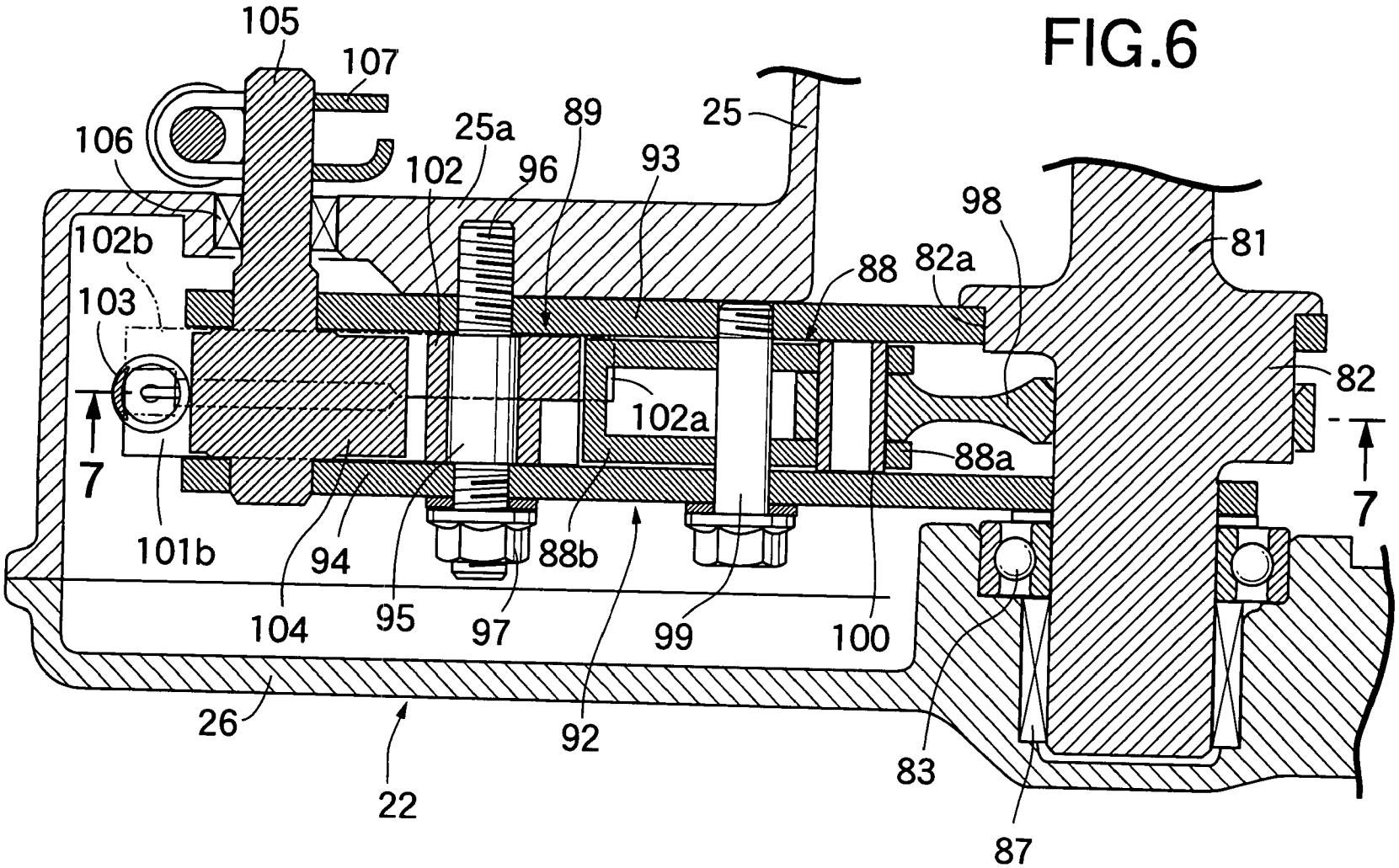
FIG. 6 is an enlarged sectional view taken along the line 6—6 in FIG. 5.

Referring to FIG. 5 and FIG. 6 together, a projecting portion 25*a* projected sideway at a portion corresponding to the eccentric shaft 82 is integrally formed at the case body 25 of the crankcase 22, and a support means 92 is mounted to the projecting portion 25*a*. The support means 92 includes a first support plate 93 abutting to an inner surface of the projecting portion 25*a*, a second support plate 94 disposed at a position separated from the first support plate 93 along an axial line of the eccentric shaft 82 to oppose the first support plate 93, and cylindrical spacers 95, 95 . . . interposed at a plurality of, for example, three positions between the first and second support plates 93 and 94.

A plurality of, for example, three bolts 96, 96 . . . corresponding to the respective spacers 95, 95 . . . are implanted in the projecting portion 25*a* of the case body 25 to have an axis parallel to the rotary shaft 81. The support means 92 is mounted to the projecting portion 25*a* in the case body 25 of the crankcase 22 by screwing and fastening nuts 97, 97 . . . engaged with the second support plate 94 from an outer surface side, to the respective bolts 96, 96 . . . inserted through the first support plate 93, the respective spacers 95, 95 . . . , and the second support plate 94.

The rotary shaft 81 rotatably penetrates through the first and second support plates 93 and 94. A portion of the rotary shaft 81 penetrating through the first support plate 93 of the eccentric shaft 82 is formed to be a circular portion 82*a* coaxial with the rotary shaft 81.

One end of a reciprocating rod 98 is rotatably connected to the eccentric shaft 82 which is at the eccentric position of the rotary shaft 81. On the other hand, the restricted member 88 is inserted in between the first and second support plates 93 and 94 of the support means 92, and rotatably supported at both the support plates 93 and 94 via a support shaft 99 parallel to the eccentric shaft 82. The restricted member 88 includes: a connecting arm portion 88*a* with its base end swingably supported at the support shaft 99; and a locking portion 88*b* formed to be a sector shape with one of the spacers 95, 95 . . . as a hinge and connected to a base portion of the connecting arm portion 88*a*, the connecting arm portion 88*a* and the locking portion 88*b* being connected to each other at a substantially right angle. The other end of the reciprocating rod 98 is connected to a tip end of the connecting arm portion 88*a* via a connecting pin 100 parallel to the support shaft 99.

Figure 7:
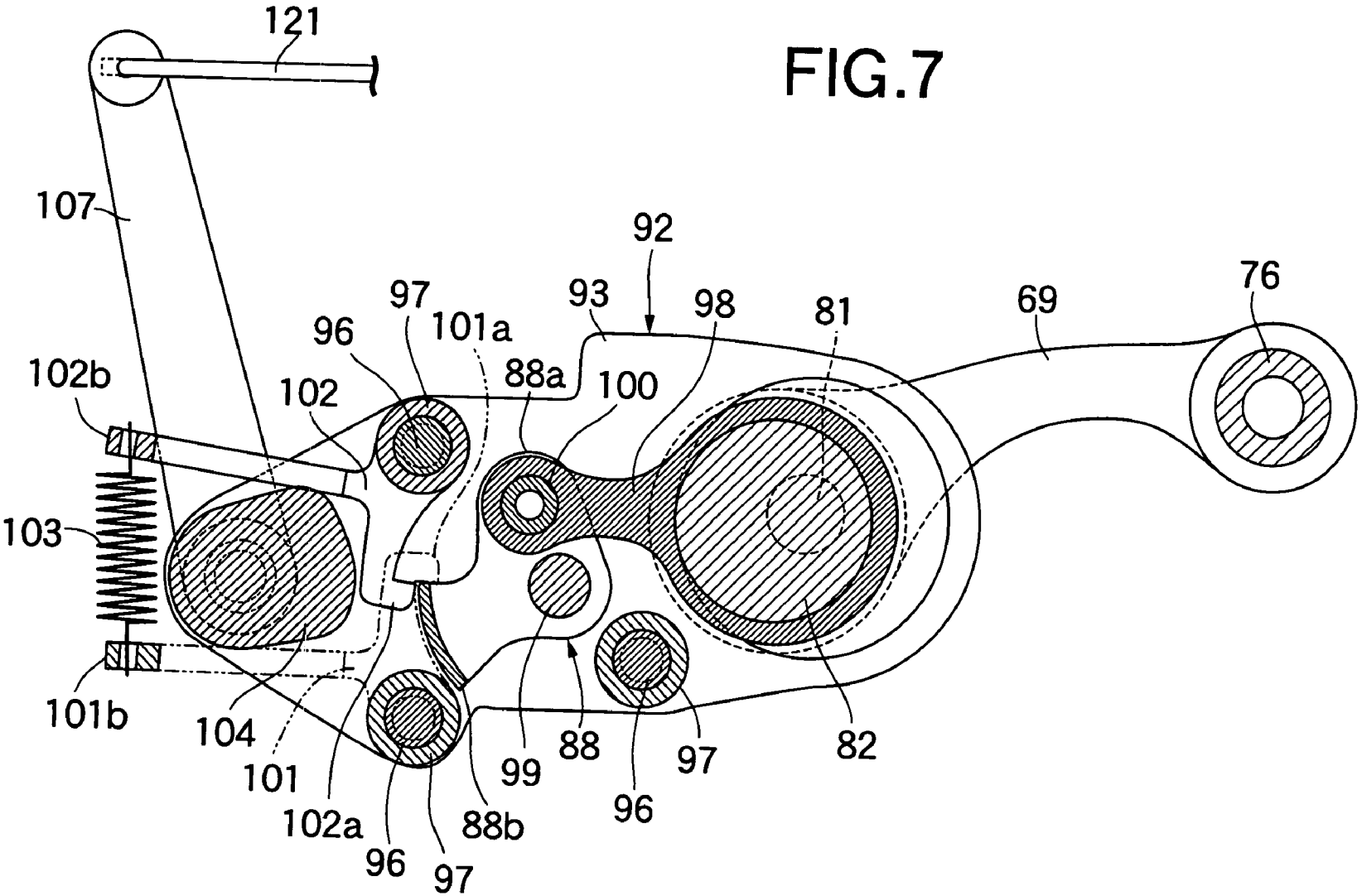
FIG. 7 is a sectional view taken along the line 7—7 in FIG. 6 of a state immediately after a restricted member passes a first reciprocation end.
Figure 8:
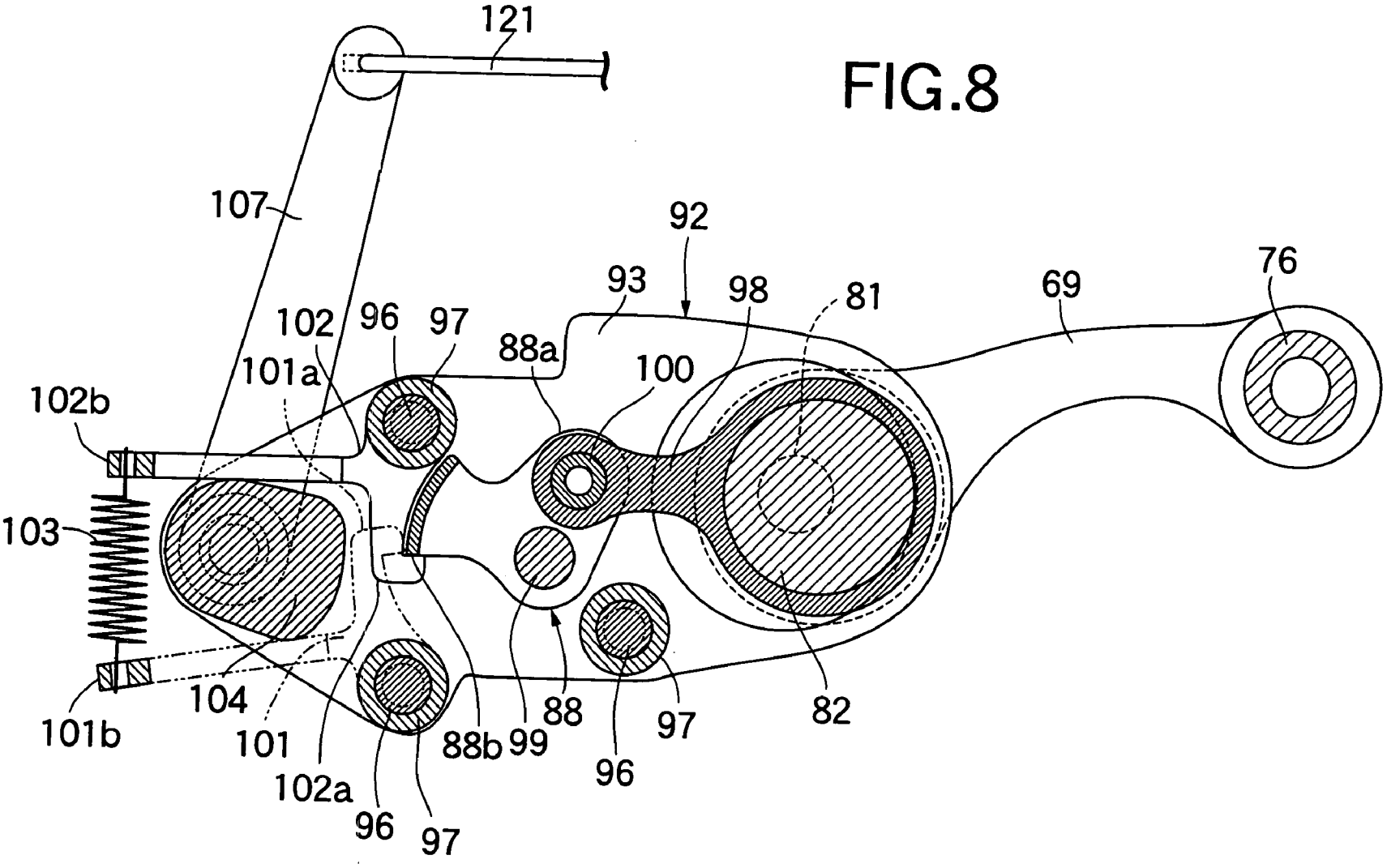
FIG. 8 is a sectional view of a state immediately after the restricted member passes a second reciprocation end, corresponding to FIG. 7.

In a state in which the restricted member 88 is not restricted by the restricting means 89, and the rotary shaft 81 can be freely rotated, the reciprocating rod 98 is reciprocally operated to the left and the right in FIG. 7 and FIG. 8 corresponding to the rotational operation of the rotary shaft 81 following sliding movement of the piston 38. According to such reciprocating operation of the reciprocating rod 98, the restricted member 88 reciprocally turns up and down between a first reciprocation end set at the lower side in FIG. 7 and FIG. 8 and a second reciprocation end set at the upper side in FIG. 7 and FIG. 8.

The restricting means 89 includes: a first restricting member 101 having a first engaging portion 101*a* capable of abutting to and engaging with the locking portion 88*b* of the restricted member 88 from one side in a circumferential direction (upper side in the embodiment) as shown in FIG. 7, immediately after the restricted member 88 passes the first reciprocation end, namely, immediately after the restricted member 88 changes the operating direction from a downward direction to an upward direction; and a second restricting member 102 having a second engaging portion 102*a* capable of abutting to and engaging with the locking portion 88*b* of the restricted member 88 from the other side in the circumferential direction (lower side in the embodiment) as shown in FIG. 8, immediately after the restricted member 88 passes the second reciprocation end, namely, immediately after the restricted member 88 changes the operating direction from the upward direction to the downward direction; the first and second restricting members 101 and 102 being rotatably supported at the support means 92 while interlocking with and connecting to each other so that when one of the first and second engaging portions 101*a* and 102*a* abuts to and engages with the locking portion 88*b*, the other of the first and second engaging portions 101*a* and 102*a* is retreated to a position where it avoids abutment to and engagement with the locking portion 88*b*.

A pair of spacers 95 and 95 among the plurality of spacers 95, 95 . . . in the support means 92 are disposed at vertical two positions on an opposite side from the rotary shaft 81 with respect to the support shaft 99. The first restricting member 101 is rotatably supported by the lower one of the spacers 95, and 95, and the second restricting member 102 is rotatably supported by the upper one of the spacers 95 and 95.

Base portions of the first and second restricting members 101 and 102 are rotatably supported by the spacers 95 and 95 to be sandwiched between both the support plates 93 and 94 of the support means 92. The first engaging portion 101*a* is generally formed into an L-shape to be engaged from above with a half portion at one side in a width direction of the locking portion 88*b* disposed between the support plates 93 and 94, and is provided at the first restricting member 101. The second engaging portion 102*a* is generally formed into an L-shape to be engaged from above with a half portion at the other side in the width direction of the locking portion 88*b*, and is provided at the second restricting member 102. Namely, the first and second engaging portions 101*a* and 102*a* are capable of being in sliding contact with each other, and are disposed between the first and second support plates 93 and 94.

The first and second restricting members 101 and 102 are provided with arm portions 101*b* and 102*b* extending to an opposite side from the restricted member 88. An interlocking spring 103 is provided under compression between tip ends of the arm portions 101*b* and 102*b*, to exhibit a spring force in a direction in which the tip ends of both the arm portions 101*b* and 102*b* move closer to each other, namely, in a direction in which the first and second engaging portions 101*a* and 102*a* abut to and engage with the locking portion 88*b* of the restricted member 88.

A cam 104 is housed between the support plates 93 and 94 so that the arm portions 101*b* and 102*b* of the first and second restricting members 101 and 102 are always in abutment to the cam 104 by the spring force of the interlocking spring 103. The cam 104 pivots to swing the first and second restricting members 101 and 102 so as to switch over: a state in which the first engaging portion 101*a* abuts to and engages with the locking portion 88*b* of the restricted member 88 and the second engaging portion 102*a* retreats to avoid engagement with the locking portion 88*b*, immediately after the restricted member 88 passes the first reciprocation end as shown in FIG. 7; a the state in which the second engaging portion 102*a* abuts to and engages with the locking portion 88*b* of the restricted member 88 and the first engaging portion 101*a* is retreated to avoid engagement with the locking portion 88*b*, immediately after the restricted member 88 passes the second reciprocation end as shown in FIG. 8. Only when the cam 104 is pivotally driven to switch the compression ratio, the restriction to the restricted member 88 by the restricting means 89 is released, and only at that time, the rotary shaft 81 is rotated, the reciprocating rod 98 is reciprocally operated, and the restricting member 88 is rotated.

The cam 104 has an axis parallel to the rotary shaft 81, and is provided at a rotary shaft 105 rotatably supported by the first and second support plates 93 and 94. One end of the rotary shaft 105 rotatably penetrates through the projecting portion 25*a* of the case body 25 in the crankcase 22, and an annular seal member 106 is interposed between the rotary shaft 105 and the projecting portion 25*a*. A lower portion of a vertically extending arm 107 is fixed to one end of the rotary shaft 105 outside the crankcase 22, and a diaphragm-type actuator 108 is connected to an upper end of the arm 107.

Figure 9:
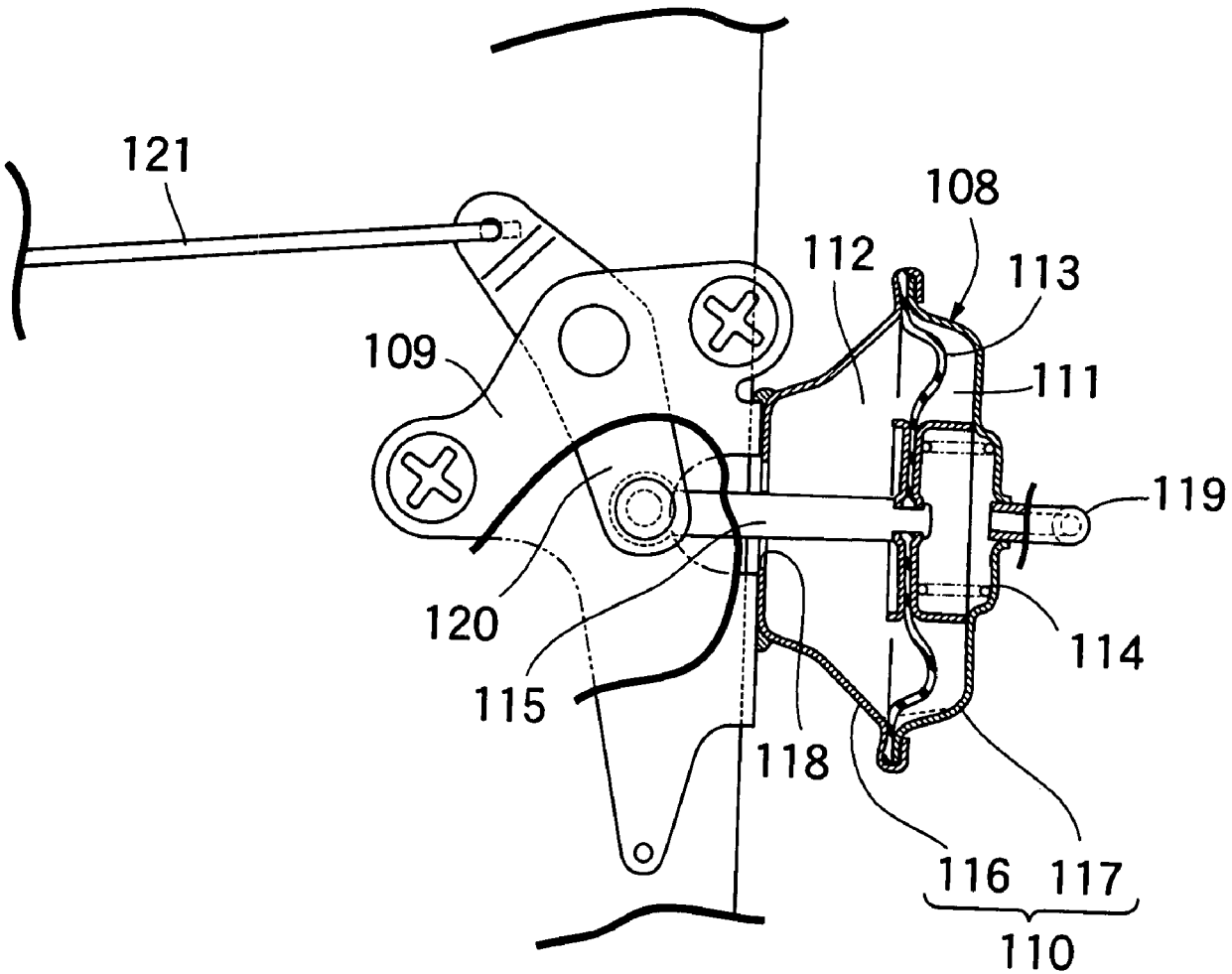
FIG. 9 is a partially cutaway plane view of an actuator in a light engine load state.
Figure 10:
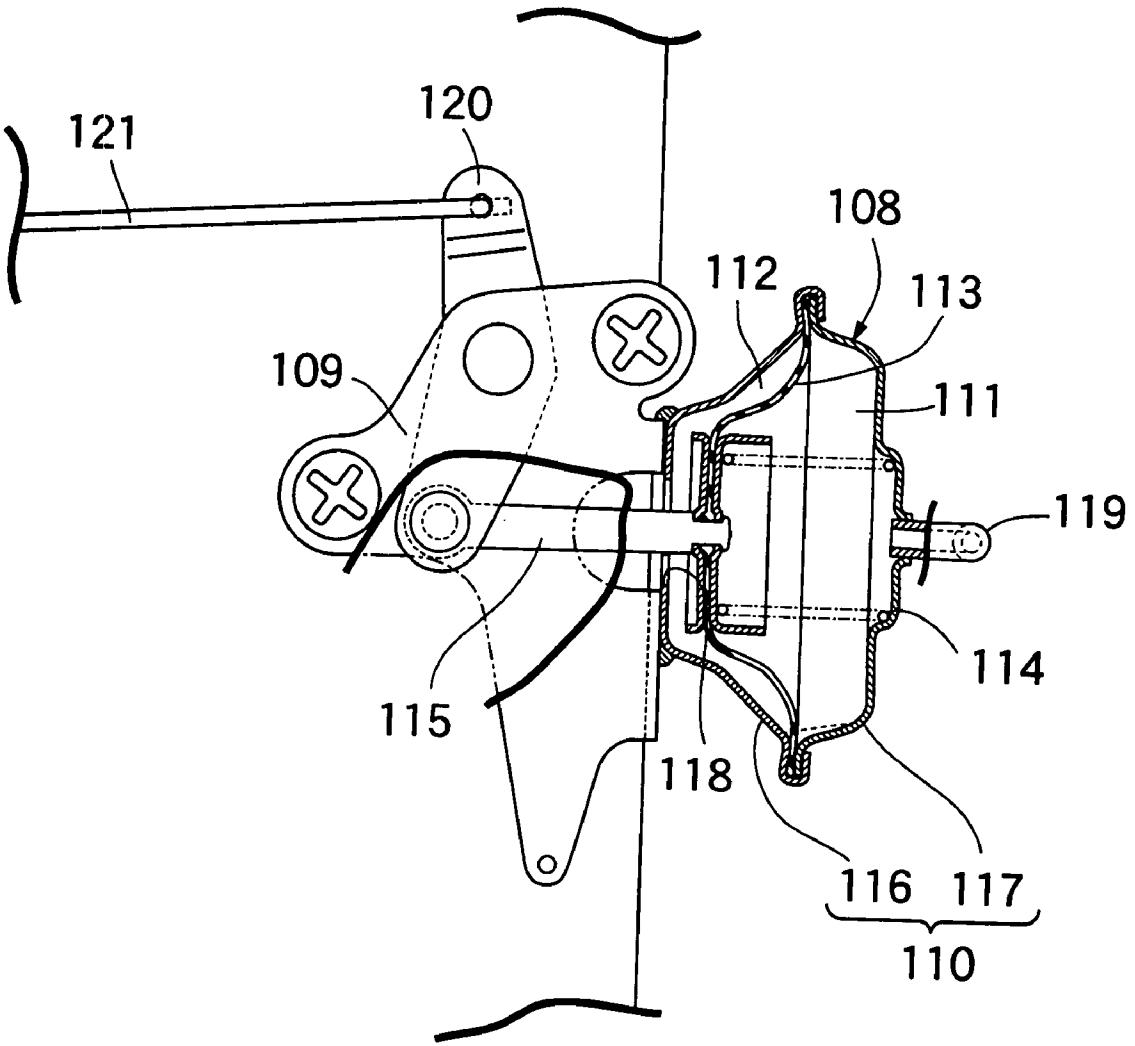
FIG. 10 is a view corresponding to FIG. 9, but in a heavy engine load state.

In FIG. 9 and FIG. 10, the actuator 108 includes a casing 110 mounted to a support plate 109 fastened to an upper portion of the case body 25 in the crankcase 22, a diaphragm 113 supported at the casing 110 to partition an inside of the casing 110 into a negative pressure chamber 111 and an atmospheric pressure chamber 112, a spring 114 exhibiting a spring force in a direction to increase the volume of the negative pressure chamber 111 and provided under compression between the casing 110 and the diaphragm 113, and an operating rod 115 connected a central portion of the diaphragm 113.

The casing 110 is constituted of a cup-shaped first half case body 116 mounted to the support plate 109, and a cup-shaped second half case body 117 joined to the half case body 116 by crimping, and a peripheral edge of the diaphragm 113 is sandwiched between opening ends of both the half case bodies 116 and 117. The negative pressure chamber 111 is formed between the diaphragm 113 and the second half case body 117, and the spring 114 is housed in this negative pressure chamber 111.

The atmospheric pressure chamber 112 is formed between the diaphragm 113 and the first half case body 116. One end of the operating rod 115 enters the atmospheric pressure chamber 112 through a through-hole 118 provided at a central portion of the first half case body 116, to be connected to a central portion of the diaphragm 113, and the atmospheric chamber 112 communicates with the outside via a gap between an inner circumference of the through-hole 118 and an outer circumference of the operating rod 115.

A conduit 119 communicating with the negative pressure chamber 111 is connected to the second half case body 117 in the casing 110. The conduit 119 is also connected to a downstream end of the intake passage 46 of the carburetor 35. Namely, intake negative pressure of the intake passage 46 is introduced into the negative pressure chamber 111 of the actuator 108. The other end of the operating rod 115 of the actuator 108 is connected to one end of a drive arm 120 rotatably supported at the support plate 109.

In a state in which the engine is operating under a light load and the negative pressure of the negative pressure chamber 111 is high, the diaphragm 113 is bent to reduce the volume of the negative pressure chamber 111 against the spring force of the spring 114 as shown in FIG. 9, and the operating rod 115 is operated to contract. In this state, the arm 107 pivots as shown in FIG. 7, and the first engaging portion 101*a* of the first restricting member 101 is in the state capable of abutting to and engaging with the locking portion 88*b* of the restricted member 88.

On the other hand, when the engine operates under a high load and the negative pressure of the negative pressure chamber 111 becomes low, the diaphragm 113 is bent to increase the volume of the negative pressure chamber 111 by the spring force of the spring 114 as shown in FIG. 10, and the operating rod 115 operates to expand. As a result, the arm 107 pivots as shown in FIG. 8, and the second engaging portion 102*a* of the second restricting member 102 is in the state capable of abutting to and engaging with the locking portion 88*b* of the restricted member 88.

Operation of this embodiment will be described below. When the engine is in a light load state, the first engaging portion 101*a* of the first restricting member 101 in the restricting means 89 abuts to and engages with the locking portion 88*b* of the restricted member 88 by the actuator 108, whereby the operation of the rotary shaft 81 is stopped and held in the rotation phase in which the center of the eccentric shaft 61 is separated from the crankshaft 27 with respect to the center of the rotary shaft 81. As a result, the engine is operated at a low compression ratio at which the operation stroke of the piston 38 is comparatively shortened. When the engine is in a high load state, the second engaging portion 102*a* of the second restricting member 102 in the restricting means 89 abuts to and engages with the locking portion 88*b* of the restricted member 88 by the actuator 108, whereby the operation of the rotary shaft 81 is stopped and held in the rotation phase in which the center of the eccentric shaft 61 comes closer to the crankshaft 27 than the center of the rotary shaft 81. As a result, the engine is operated at the high compression ratio at which the operation stroke of the piston 38 is made comparatively long. Namely, the engine is operated by switching over between the low compression ratio under the light load to the engine and the high compression ratio under the high load to the engine.

In addition, the rotating direction of the rotary shaft 81 in accordance with the rotational force acting on the rotary shaft 81 from the control rod 69 via the eccentric shaft 61 with the reciprocating operation of the piston 38 is restricted to one direction by the one-way clutch 87 interposed between the rotary shaft 81 and the crankcase 22 of the engine body 21, and the compression ratio is switched to a high level and a low level by selectively restricting the rotational operation of the rotary shaft 81 in either of the two rotation phases different from each other, by making the restricting means 89 abut to and engage with the restricted member 88 which interlocks with and connects to the rotary shaft 81 immediately after the restricted member 88 reciprocally turning between the first and second reciprocation ends passes the first and second reciprocation ends. Therefore, the restricting means 89 abuts to and engages with the restricted member 88 in the sate in which the operating speed of the restricted member 88 is low, thus suppressing the impact at the time of switching the compression ratio to be low and the occurrence of the impact noise.

The restricted member 88 is supported at the support means 92 mounted to the crankcase 22 of the engine body 21 to be rotatable around the axis parallel to the rotary shaft 81. The other end of the reciprocating rod 98 of which one end is connected to the eccentric position of the rotary shaft 81 is connected to the restricted member 88 to be rotatable around the axis coaxial with the eccentric shaft 61. The restricting means 89 is formed by rotatably supporting at the support means 92, the first restricting member 101 having the first engaging portion 101*a* capable of abut to and engage with the locking portion 88*b* of the restricted member 88 from one side in the circumferential direction immediately after the restricted member 88 passes the first reciprocation end, and the second restricting member 102 having the second engaging portion 102*a* capable of abutting to and engaging with the locking portion 88*b* of the restricted member 88 from the other side in the circumferential direction immediately after the restricted member 88 passes the second reciprocation end, by interlocking and connecting the first restricting member 101 and the second restricting member 102 to each other so that when one of the first and second engaging portions 101*a* and 102*a* can be made to abut to and engage with the locking portion 88*b*, the other one of the first and second engaging portions 101*a* and 102*a* is retreated to the position at which it can avoid the abutment to and engagement with the locking portion 88*b*. The actuator 108 supported at the crankcase 22 of the engine body 21 to be operated corresponding to the engine load is interlocked with and connected to the first and second restricting members 101 and 102 to rotationally drive the first and second restricting members 101 and 102.

Accordingly, one of the first and second engaging portions 101*a* and 102*a* can be made to abut to and engage with the locking portion 88*b* of the restricted member 88 immediately after the restricted member 88 passes the reciprocation end, by pivotally driving the first and second restricting members 101 and 102 of the restricting means 89 by the operation of the actuator 108 operated corresponding to the engine load. Therefore, the compression ratio can be switched to a high level and a low level in accordance with the engine load, while alleviating the impact at the time of switching the compression ratio to be low in the simple structure.

The embodiment of the present invention has been described above, but the present invention is not limited to the above described embodiment, and various changes in design may be made without deviating from the present invention described in the claims.

For example, in the above-described embodiment, the restricted member 88, the first and second restricting members 101 and 102 of the restricting means 89 are pivotally supported at the support means 92 mounted to the crankcase 22 of the engine body 21, but the restricted member 88, and the first and second restricting members 101 and 102 may be rotatably supported at the crankcase 22 of the engine body 21.

What is claimed is:

1. A variable compression ratio engine including: a connecting rod with one end connected to a piston via a piston pin; a subsidiary arm connected to a crankshaft via a crank pin with one end rotatably connected to the other end of the connecting rod; an eccentric shaft provided at an eccentric position of a rotary shaft rotatably supported at an engine body; and a control rod with one end connected to the subsidiary arm at a position deviated from the connecting position with the connecting rod and the other end pivotally connected to the eccentric shaft, wherein the engine further includes:

a one-way clutch interposed between the rotary shaft and the engine body so as to restrict a rotating direction of the rotary shaft to one direction, the rotating direction of the rotary shaft corresponding to a rotational force which acts on the rotary shaft via the eccentric shaft from the control rod following a reciprocating operation of the piston;

a restricted member linked and connected to the eccentric position of the rotary shaft to reciprocally operate in response to rotation of the rotary shaft; and a restricting means for switching a compression ratio to a high level and a low level by selectively restricting a rotational operation of the rotary shaft in either of two rotation phases different from each other in such a manner that the restricting means abuts to and engages with the restricted member immediately after the restricted member passes a reciprocation end.

2. The variable compression ratio engine according to claim 1, wherein the restricted member has a locking portion and is supported at the engine body or a support means mounted to the engine body to be rotatable around an axis line parallel to the rotary shaft, wherein a reciprocating rod has one end connected to the eccentric position of the rotary shaft to be rotatable around an axis line coaxial with the eccentric shaft, and has the other end connected to the restricted member so that the restricted member is pivotally reciprocated between first and second reciprocation ends corresponding to the rotation of the rotary shaft, wherein the restricting means includes a first restricting member having a first engaging portion capable of abutting to and engaging with the locking portion from one side in a circumferential direction immediately after the restricted member passes the first reciprocation end, and a second restricting member having a second engaging portion capable of abutting to and engaging with the locking portion of the restricted member from the other side in the circumferential direction immediately after the piston passes the second reciprocation end, the first and second engaging portions being pivotally supported at the engine body or the support means while interlocking with and connecting to each other so that when one of the first and second engaging portions abuts to and engages with the locking portion, the other one of the first and second engaging portions is retreated to a position where it avoid abutment to and engagement with the locking portion, and wherein an actuator supported at the engine body to be operated in accordance with an engine load is interlocked with and connected to the first and second restricting members to pivotally drive the first and second restricting members.

* * * * *